US007192285B2

(12) United States Patent
Makino et al.

(10) Patent No.: US 7,192,285 B2
(45) Date of Patent: Mar. 20, 2007

(54) DOOR HANDLE FOR VEHICLE

(75) Inventors: Sadayuki Makino, Nagoya (JP); Tetsurou Tanimoto, Anjo (JP); Koichi Nagata, Obu (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 171 days.

(21) Appl. No.: 11/090,886

(22) Filed: Mar. 28, 2005

(65) Prior Publication Data

US 2005/0212308 A1 Sep. 29, 2005

(30) Foreign Application Priority Data

Mar. 29, 2004 (JP) ..... 2004-095745
Mar. 29, 2004 (JP) ..... 2004-095746

(51) Int. Cl.
*H01R 33/00* (2006.01)

(52) U.S. Cl. ..... 439/34; 200/600

(58) Field of Classification Search ..... 439/34; 200/600, 61.62

See application file for complete search history.

(56) References Cited

U.S. PATENT DOCUMENTS 6,363,577 B1 * 4/2002 Spitzley ..... 292/336.3
6,447,030 B1 * 9/2002 Meinke ..... 292/347
6,740,834 B2 * 5/2004 Sueyoshi et al. ..... 200/600
6,769,154 B1 * 8/2004 Klein et al. ..... 16/412
6,980,171 B2 * 12/2005 Maruyama et al. ..... 343/788
7,018,214 B2 * 3/2006 Fukunaga et al. ..... 439/34
7,057,124 B2 * 6/2006 Ieda et al. ..... 200/61.62

FOREIGN PATENT DOCUMENTS

JP 2002-030844 1/2002

* cited by examiner

*Primary Examiner*—Thanh-Tam Le
(74) *Attorney, Agent, or Firm*—Buchanan Ingersoll & Rooney PC

(57) ABSTRACT

A door handle for a vehicle includes a housing member having a first end portion, a second end portion, and a recessed portion provided between the first end portion and the second end portion of the housing member, a first electronic component accommodated in the recessed portion of the housing member, and a covering member for covering the recessed portion of the housing member. The covering member includes a horizontal surface and an inclined surface inclined relative to the horizontal surface provided at one end of the covering member in a longitudinal direction thereof, the recessed portion of the housing member includes a receiving surface provided at one end of the recessed portion to be in contact with the inclined surface, and a first projecting portion provided at the one end of the recessed portion to be in contact with the horizontal surface, the one end of the covering member is engaged with the one end of the recessed portion, and the other end of the covering member is fastened to the housing member so that the housing member and the covering member are formed as a unit.

17 Claims, 2 Drawing Sheets

DOOR HANDLE FOR VEHICLE

CROSS REFERENCE TO RELATED APPLICATIONS

This application is based on and claims priority under 35 U.S.C. § 119 to Japanese Patent Application 2004-095745, filed on Mar. 29, 2004, and Japanese Patent Application 2004-095746, filed on Mar. 29, 2004, the entire content of which is incorporated herein by reference.

FIELD OF THE INVENTION

This invention generally relates to a door handle for a vehicle, and suitable for use on a door of a vehicle.

BACKGROUND

As a conventional door handle for a vehicle, a door handle described in JP2002-30844A is known. The door handle for a vehicle includes a housing member in which a front arm portion provided at a front portion of the housing member and a rear arm portion provided at a rear portion of the housing member are formed. The housing member includes a recessed portion between the front arm portion and the rear arm portion. In the recessed portion, electronic parts are accommodated. The recessed portion is covered by a covering member.

In this door handle for a vehicle, a first end and second end of the covering member are fastened to the housing member by use of a fastening member such as a screw. Then, the recessed portion of the housing member is covered by the covering member, a procedure which ensures an accommodation of electronic parts in the recessed portion.

However, in the door handle for a vehicle described above, the first end and the second end of the covering member need to be fastened to the housing member by means of the fastening member. The process of fastening, in other words, a process of combining the housing member and the covering member into a single member, is troublesome.

In the door handle for a vehicle, electronic parts are accommodated in the recessed portion of the housing, while the electronic parts are provided between the housing member and the covering member. At this time, for preventing displacement of the electronic parts between the housing member and the covering member, the housing member and the covering member need to be firmly fastened. In order to achieve this, the first end and the second end of the covering member need to be fastened to the housing member by means of the fastening member. For fastening the first end and the second end of the covering member to the housing member by use of the fastening member in this way, a fastening tool such as a driver should be used. As a result, the process of fastening, in other words, a process of combining the housing member and the covering member into a single member, becomes troublesome. Moreover, after simultaneously aligning positions of the housing member and the first and second ends of the covering member, the first and second ends need to be fastened to the housing member. At that time, there is a danger of the covering member being disposed on the recessed portion without an adequate check being made the condition of electronic parts accommodated in the recessed portion. Accordingly, there is a likelihood that the covering member will be disposed on the recessed portion in a condition in which the electronic parts (including a harness extending from the electronic parts) accommodated in the recessed portion are not positioned necessarily always in the same positions as envisaged at the design stage.

A need thus exists for a door handle for a vehicle, in which a housing member and a covering member can be combined in a simple manner, and in which electronic parts can be accommodated in positions which conform to those envisaged in a design.

SUMMARY OF THE INVENTION

According to an aspect of the present invention, a door handle for a vehicle includes a housing member having a first end portion, a second end portion, and a recessed portion provided between the first end portion and the second end portion of the housing member, a first electronic component accommodated in the recessed portion of the housing member, and a covering member for covering the recessed portion of the housing member. The covering member includes a horizontal surface and an inclined surface inclined relative to the horizontal surface provided at one end of the covering member in a longitudinal direction thereof, the recessed portion of the housing member includes a receiving surface provided at one end of the recessed portion to be in contact with the inclined surface, and a first projecting portion provided at the one end of the recessed portion to be in contact with the horizontal surface, the one end of the covering member is engaged with the one end of the recessed portion, and the other end of the covering member is fastened to the housing member so that the housing member and the covering member are formed as a unit.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
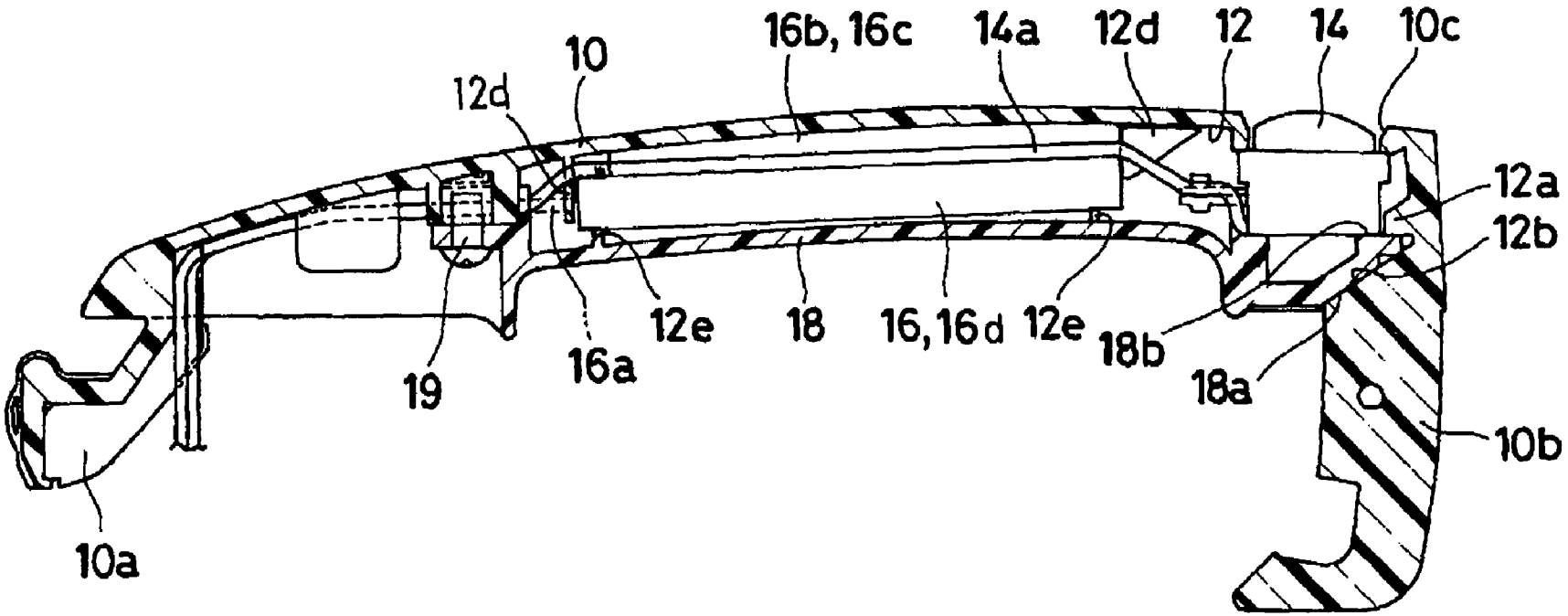
FIG. 1 shows a cross-sectional view of an entire door handle for a vehicle in a vertical direction according to an embodiment of the present invention.
Figure 2:
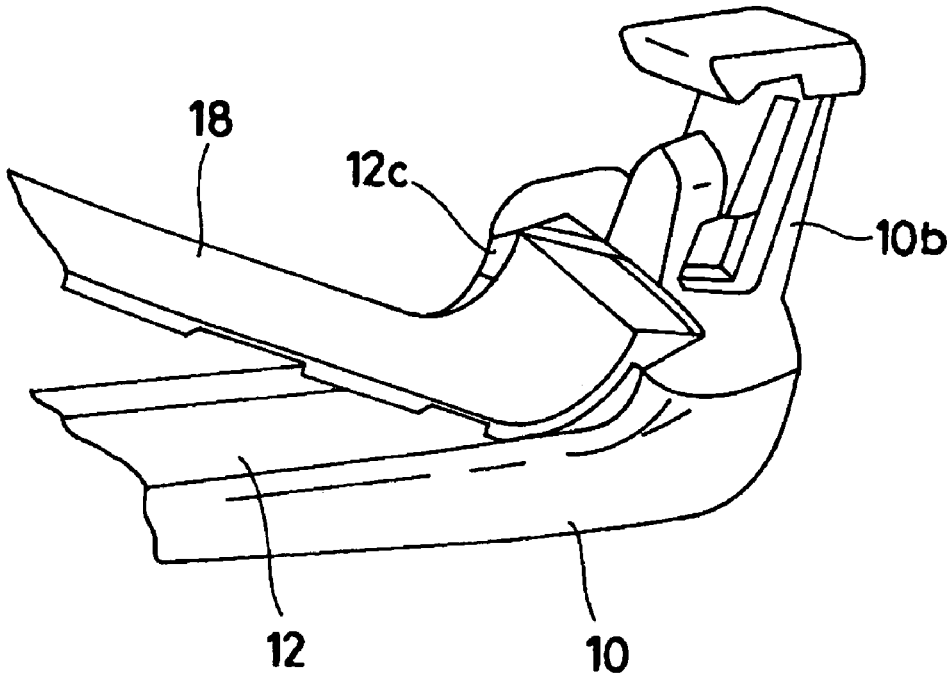
FIG. 2 shows a partially enlarged perspective view of the door handle for a vehicle according to the embodiment of the present invention.

An embodiment of the present invention will be explained with reference to drawing figures. A door handle for a vehicle according to an embodiment of the present invention includes, as shown in FIG. 1, a housing member 10 made of resin. The housing member 10 includes a front arm portion 10*a* provided at a front end (second end) of the housing member 10, and a rear arm portion 10*b* provided at a rear end (first end) of the housing member 10. A recessed portion 12 is formed at the housing member 10, in a position between the front arm portion 10*a* and the rear arm portion 10*b*. An opening portion 10*c* is formed at the housing member 10 near the rear arm 10*b*. Furthermore, a projecting portion 12*a* is formed near a first end of the recessed portion 12 (near the rear arm portion 10*b*). An inclined receiving surface 12*b* is formed from the projecting portion 12*a* formed at the recessed portion 12 as far as the rear arm portion 10*b*. Furthermore, as shown in FIG. 2, a guiding groove 12*c* is formed at a side surface formed at the recessed portion 12, a surface located near the rear arm portion 10*b*. The guiding groove 12*c* is inclined along the inclined angle of inclined receiving surface 12*b*.

A lock/unlock switch 14, serving as an electronic component, is provided at the opening portion 10*c* of the recessed portion 12. A projecting portion 12*d* is formed at the housing member 10 between the opening portion 10*c* and the center of the housing member 10. Further, a detection antenna, also serving as an electronic component, is accommodated at a center portion of the recessed portion 12. At this time, the detection antenna makes contact with the projecting portion 12*d*. Here, the lock/unlock switch serves for locking/unlocking a door of a vehicle, the detection antenna 16 is serving for detecting a presence of a user of the vehicle. Harnesses 14*a*, 16*a* are respectively connected to the lock/unlock switch 14 and to the detection antenna 16. The harnesses 14*a*, 16*a* extend from the inside of the recessed portion 12 toward the front arm portion 10*a*. The detection antenna 16 is an antenna that can detect electromagnetic waves emitted from an ignition key carried by a user of the vehicle. Instead of the detection antenna 16, an electrostatic capacity sensor 16*d* can also be employed. The electrostatic capacity sensor 16*d* is a sensor that can detect whether or not the housing member is touched by a user of the vehicle.

The recessed portion 12 of the housing member 10 is covered by the covering member 18 made of resin. A horizontal surface 18*b*, and an inclined surface 18*a* inclined relative to the horizontal surface 18*b*, are formed at one end of the covering member 18 in a longitudinal direction thereof. Furthermore, a projecting portion 12*e* is formed at a side of covering member 18, a side facing to the recessed portion 12.

The one end of the covering member 18 is, as shown in FIG. 2, introduced into the housing member 10 along the guiding groove 12*c* of the housing member 10. Then, as shown in FIG. 1, the inclined surface 18*a* of the covering member 18 slides along the receiving surface 12*b* of the recessed portion 12 of the housing member 10. At this time, as shown in FIG. 1 and FIG. 2, a check can be made as to whether the lock/unlock switch 14, the detection antenna 16 and the harnesses 14*a*, 16*a* accommodated in the recessed portion 12 of the housing member 10 are in at the same positions these envisaged in the design. A degree of entanglement of the harnesses 14*a*, 16*a* can in particular be checked. Thus, the covering member 18 can be disposed while a condition of an inside of the recessed portion 12 is being checked. Then, at a time when the one end of the covering member 18 is in contact with the one end of the inside of the recessed portion 12, the inclined surface 18*a* of the covering member 18 makes contact with the receiving surface 12*b* of the recessed portion 12 of the housing member 10, and the horizontal surface 18*b* makes contact with the projecting portion 12*a* formed in the recessed portion 12 of the housing member 10. Thus, the one end of the covering member 18 can be firmly supported between the projecting portion 12*a* and the receiving surface 12*b*, both of which are formed in the recessed portion 12. In this way, the one end of the covering member 18 can be engaged to the one end of the recessed portion 12 of the housing member 10.

In addition, the other end of the covering member 18 is fastened to the recessed portion 12 of the housing member 10 by use of a screw.

Here, the detection antenna 16 provided in the recessed portion 12 of the housing member 10 is supported by use of either a projecting portion 12*d* formed at the recessed portion 12 of the housing member 10 or a projecting portion 12*e* formed at the covering member 18. Accordingly, in the recessed portion 12, movement of the detection antenna can be restricted. Further, the lock/unlock switch 14, provided in the recessed portion 12 of the housing member 10, is connected to the one end of the covering member 18.

In the door handle for a vehicle according to the embodiment of the present invention, when the one end of the covering member 18 is engaged to the one end of the recessed portion 12 of the housing member 10, while either a condition or a position of an electronic component such as a the detection antenna 16, which is accommodated in the recessed portion 12, is being visually checked, the other end of the covering member 18 can be fastened to the housing member 10 by use of a screw 19. In this way, the other end of the covering member 18 can be disposed at the recessed portion 12 while a check is made as to whether the detection antenna 16 accommodated in the recessed portion 12 is in the same condition as that envisaged in the design. Then, the other end of the covering member 18 is fastened by means of a fastening tool such as a driver. Thus, a process for combining the housing member 10 and the covering member 18 into a unit can be simplified. As a result, the housing member 10 and the covering member 18 are combined into a unit in a simple way.

Accordingly, in the door handle for a vehicle according to the embodiment of the present invention, the housing member 10 and the covering member 18 can be combined in a simple manner. Furthermore, an electronic component such as the detection antenna 16 can be accommodated in the same condition as that envisaged in the design.

Figure 3:
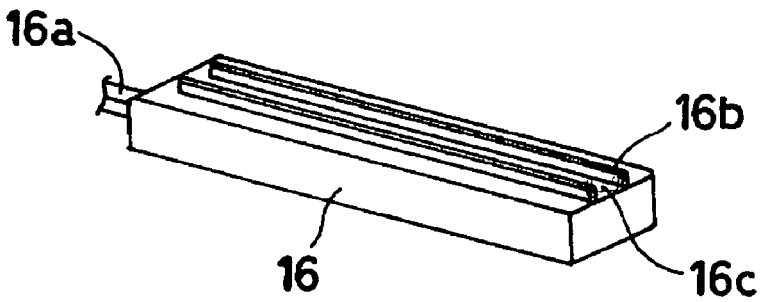
FIG. 3 shows an enlarged perspective view of a detection antenna according to the embodiment of the present invention.

In addition, as shown in FIG. 3, a projecting portion 16*b* is provided on one surface of the detection antenna 16 in a longitudinal direction. A guiding groove 16*c* is formed at the center of the projecting portion 16*b* in the same longitudinal direction. Then, as shown in FIG. 1, the harness 14*a* of the lock/unlock switch 14 is bound and guided to the guiding groove 16*c* of the detection antenna 16. Thus, the harness 14*a* of the lock/unlock switch 14, and the harness 16*a* of the detection antenna 16, combined with the harness 14*a* of the lock/unlock switch 14 extend from the inside of the recessed portion 12 of the housing 10 toward the front arm portion 10*a* of the housing 10.

The inclined surface 18*a* provided at the one end of the covering member 18 makes contact with the receiving surface 12*b* of the recessed portion 12 of the housing member 10. The horizontal surface 18*b* of the covering member 18 makes contact with the projecting portion 12*a* provided in the recessed portion 12 of the housing member 10. In this way, the one end of the covering member 18 can be firmly supported between the projecting portion 12*a* provided in the recessed portion 12 of the housing member 10 and the receiving surface 12*b* of the recessed portion 12 of the housing member 10. Thus, the one end of the covering member 18 is engaged to the one end of the recessed portion 12 of the housing member 10. In addition, the other end of the covering member 18 is fastened to the recessed portion 12 of the housing member 10 by means of a screw 19.

At this time, the projecting portion 16*b* of the detection antenna 16 is engaged with the recessed portion 12 of the housing member 10. Alternatively, the projecting portion 16*b* can be engaged with the covering member 18. In this way, it becomes difficult for the detection antenna 16 starts to move from either the housing member 10 or the covering member 18. As a result, it becomes difficult for a load to be applied to the harness 14*a* of the lock/unlock switch 14 bound at the guiding groove 16*c* of the detection antenna 16. Thus, the chances of a breakage of the harness 14*a* can be substantially reduced.

Further, because the detection antenna 16 is designed to detect a user, the detection antenna 16 is a long and narrow electronic component provided in the recessed portion 12 of the housing member 10. Thus, because the guiding groove 16*c* extends along the detection antenna 16, the harness 14*a* connected to the lock/unlock switch 14 can be easily bound to the guiding groove 16*c*.

According to an aspect of the present invention, the inclined surface formed at the one end of the covering member in a longitudinal direction makes contact with the receiving surface formed at the one end of the recessed portion of the housing member. Further, the horizontal surface of the covering member makes contact with the projecting portion formed at the one end of the recessed portion of the housing member. Thus, the one end of the covering member having the inclined surface and the horizontal surface is supported between the receiving surface and the projecting portion formed at the one end of the recessed portion of the housing member. Thus, the one end of the covering member is engaged with the one end of the recessed portion of the housing member. Then, the other end of the covering member is fastened to the housing member. In the door handle for a vehicle according to the embodiment of the present invention, when the one end of the covering member is engaged with the one end of the recessed portion of the housing member, while a condition and a position of an electronic component accommodated in the recessed portion of the housing member is being visually checked, the other end of the covering member can be fastened to the housing member by means of the fastening member. In this way, the covering member can be disposed at the recessed portion while a check is being made as to whether an electronic component (a harness extending from either one or the other electronic component is also included) accommodated in the recessed portion of the housing member is in the same condition as that envisaged in the design. Then, the other end of the covering member is fastened by means of a fastening member. In this way, a process of combining the housing member and the covering member into a unit can be simplified. As a result, costs can be reduced by reducing both the number of parts used and the time required for assembly. Accordingly, the housing member and the covering member can be combined in a simple way.

In the door handle for a vehicle according to the embodiment of the present invention, the housing member and the covering member can be combined into a unit in a simple way. Further, an electronic component can be accommodated in the same condition as that envisaged in the design.

According to a further aspect of the present invention, because the one end of the covering member is introduced into the recessed portion of the housing member along the guiding groove, an engagement between the housing member and the covering member can be ensured.

According to a further aspect of the present invention, the projecting portion formed either one or both of the housing member and the covering member restricts movement of an electronic component, and displacement of the electronic component provided between the housing member and the covering member can be prevented.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door handle for a vehicle, comprising:

a housing member having a first end portion, a second end portion, and a recessed portion provided between the first end portion and the second end portion of the housing member;

a first electronic component accommodated in the recessed portion of the housing member; and a covering member for covering the recessed portion of the housing member, wherein the covering member includes a horizontal surface and an inclined surface inclined relative to the horizontal surface provided at one end of the covering member in a longitudinal direction thereof, the recessed portion of the housing member includes a receiving surface provided at one end of the recessed portion to be in contact with the inclined surface, and a first projecting portion provided at the one end of the recessed portion to be in contact with the horizontal surface, the one end of the covering member is engaged with the one end of the recessed portion, and the other end of the covering member is fastened to the housing member so that the housing member and the covering member are formed as a unit.

2. The door handle for a vehicle according to claim 1, wherein the housing member includes a first guiding groove provided at the recessed portion of the housing member for guiding the one end of the covering member.

3. The door handle for a vehicle according to claim 1, wherein a second projecting portion is formed at either one or both of the housing member and the covering member for restricting movement of the first electronic component.

4. The door handle for a vehicle according to claim 2, wherein a second projecting portion is formed at either one or both of the housing member and the covering member for restricting movement of the first electronic component.

5. The door handle for a vehicle according to claim 1, wherein a second electronic component is provided between the housing member and the covering member, and at least one of the first electronic component and the second electronic component includes a first guiding groove for guiding a wire harness connected to the other of the first electronic component and the second electronic component.

6. The door handle for a vehicle according to claim 2, wherein a second electronic component is provided between the housing member and the covering member, and at least one of the first electronic component and the second electronic component includes a second guiding groove for guiding a wire harness connected to the other of the first electronic component and the second electronic component.

7. The door handle for a vehicle according to claim 3, wherein a second electronic component is provided between the housing member and the covering member, and at least one of the first electronic component and the second electronic component includes a first guiding groove for guiding a wire harness connected to the other of the first electronic component and the second electronic component.

8. The door handle for a vehicle according to claim 4, wherein a second electronic component is provided between the housing member and the covering member, and at least one of the first electronic component and the second electronic component includes a second guiding groove for guiding a wire harness connected to the other of the first electronic component and the second electronic component.

9. The door handle for a vehicle according to claim 6, wherein either one or both of the first electronic component and the second electronic component includes a second projecting portion forming the second guiding groove provided at either one or both of the first electronic component and the second electronic component in a longitudinal direction thereof, and the second projecting portion is capable of engaging with at least one of the housing member and the covering member.

10. The door handle for a vehicle according to claim 7, wherein either one or both of the first electronic component and the second electronic component includes a third projecting portion forming the first guiding groove provided at either one or both of the first electronic component and the second electronic component in a longitudinal direction thereof, and the third projecting portion is capable of engaging with either one or both of the housing member and the covering member.

11. The door handle for a vehicle according to claim 8, wherein either one or both of the first electronic component and the second electronic component includes a third projecting portion forming the second guiding groove provided at either one or both of the first electronic component and the second electronic component in a longitudinal direction thereof, and the third projecting portion is capable of engaging with either one or both of the housing member and the covering member.

12. The door handle for a vehicle according to claim 9, wherein at least one of the first electronic component and the second electronic component is a detection antenna for detecting an electromagnetic wave emitted by an ignition key carried by a user of the vehicle.

13. The door handle for a vehicle according to claim 10, wherein at least one of the first electronic component and the second electronic component is a detection antenna for detecting an electromagnetic wave emitted by an ignition key carried by a user of the vehicle.

14. The door handle for a vehicle according to claim 11, wherein at least one of the first electronic component and the second electronic component is a detection antenna for detecting an electromagnetic wave emitted by an ignition key carried by a user of the vehicle.

15. The door handle for a vehicle according to claim 9, wherein at least one of the first electronic component and the second electronic component is an electrostatic capacity sensor for detecting whether or not the housing member is touched by a user of the vehicle.

16. The door handle for a vehicle according to claim 10, wherein at least one of the first electronic component and the second electronic component is an electrostatic capacity sensor for detecting whether or not the housing member is touched by a user of the vehicle.

17. The door handle for a vehicle according to claim 11, wherein at least one of the first electronic component and the second electronic component is an electrostatic capacity sensor for detecting whether or not the housing member is touched by a user of the vehicle.

* * * * *